United States Patent [19]

Toth

[11] 4,233,817

[45] Nov. 18, 1980

[54] REFRIGERATION APPARATUS

[75] Inventor: Steven J. Toth, Elkhart, Ind.

[73] Assignee: Miles Laboratories, Inc., Elkhart, Ind.

[21] Appl. No.: 957,465

[22] Filed: Nov. 3, 1978

[51] Int. Cl.[3] ..... F25B 7/00; F25B 25/00

[52] U.S. Cl. ..... 62/175; 62/185; 62/332; 165/39

[58] Field of Search ..... 62/175, 185, 332, 99; 165/39

[56] References Cited

U.S. PATENT DOCUMENTS

| | | | |
|---|---|---|---|
| 2,352,282 | 6/1944 | Newton | 62/332 |
| 3,015,940 | 1/1962 | Harwich | 62/332 |
| 3,512,370 | 5/1970 | Murphy et al. | 62/332 |
| 3,757,531 | 9/1973 | Gement, Jr. | 62/209 |

*Primary Examiner*—William E. Wayner
*Assistant Examiner*—Harry B. Tanner
*Attorney, Agent, or Firm*—Louis E. Davidson

[57] ABSTRACT

Apparatus is described for maintaining refrigerant temperature at or below a predetermined level by providing a combination of a primary chiller cooled by a primary mechanical refrigeration system and a series-connected back-up liquid nitrogen-cooled chiller which would operate only if the primary mechanical refrigeration system is incapable of providing the desired refrigerant temperature.

9 Claims, 1 Drawing Figure

REFRIGERATION APPARATUS

BACKGROUND AND PRIOR ART

Mechanical cascade refrigeration systems are well-known in the art for providing various desired levels of refrigeration. In the event that substantially constant refrigeration levels must be maintained, the refrigeration system must have some form of emergency back-up protection. A duplicate mechanical refrigeration system may be employed as back-up, but this is generally quite expensive.

Liquid nitrogen cooling systems are also known in the art. In one form of liquid nitrogen cooling system, the liquid nitrogen is sprayed or atomized into the chamber being cooled. While this provides rapid cooling, it has several disadvantages. First, the liquid nitrogen is at a temperature of about −320° F. (−196° C.). If it comes in direct contact with various materials, such as the material being cooled or the gaskets of the cooling chamber, damage may occur to such materials. Second, the gaseous nitrogen resulting from evaporation of the liquid nitrogen is an inert substance which can displace air from the cooling chamber. This can be hazardous to any humans or animals present in the cooling chamber. This form of refrigeration is not suitable for long term primary maintenance of cooling chambers because of the expensive consumption of liquid nitrogen. If this form of liquid nitrogen cooling is employed as a back-up to a mechanical refrigeration system it has several disadvantages. It will have the above inherent disadvantages and will also require separate cooling apparatus connections to the chamber being cooled.

In another form of liquid nitrogen cooling system a chiller or heat exchanger can be employed wherein liquid nitrogen on one side of the heat exchanger can cool a refrigerant on the other side of the heat exchanger. Here again, this type of apparatus is not suitable for long term primary maintenance of cooling chambers because of the expensive consumption of liquid nitrogen. If this form of liquid nitrogen cooling is employed as a back-up to a mechanical refrigeration system, it has several disadvantages. It will require duplicate refrigerant circulation systems with duplicate pumps and conduits connected to the cooling chamber. This adds to the overall expense. Since the refrigerant in the back-up system will normally be at room or ambient temperature, there will be a delay in getting the back-up system to desired low temperature. The liquid nitrogen will be employed only when needed as back-up and it will first need to cool the refrigerant.

There is thus a need for a quick-acting liquid nitrogen-cooled back-up refrigeration apparatus available at minimum expense.

SUMMARY OF THE INVENTION

In accordance with the present invention, refrigeration apparatus is provided for maintaining the temperature in a circulating refrigerant at or below a predetermined level which comprises in combination a first chiller associated with a primary refrigeration system, a second chiller, a refrigerant pump, refrigerant conduits for circulating refrigerant in series through said pump and said first and second chillers, a first sensor for sensing the temperature of the circulating refrigerant and providing output signals based thereon, and valve means associated with said second chiller and responsive to signals from said first sensor for supplying liquid nitrogen from a source to said second chiller whenever the temperature of the circulating refrigerant rises above a predetermined level.

DESCRIPTION OF THE DRAWING

The single FIGURE is a schematic diagram of the apparatus of the present invention.

DESCRIPTION OF THE INVENTION

Figure 1:
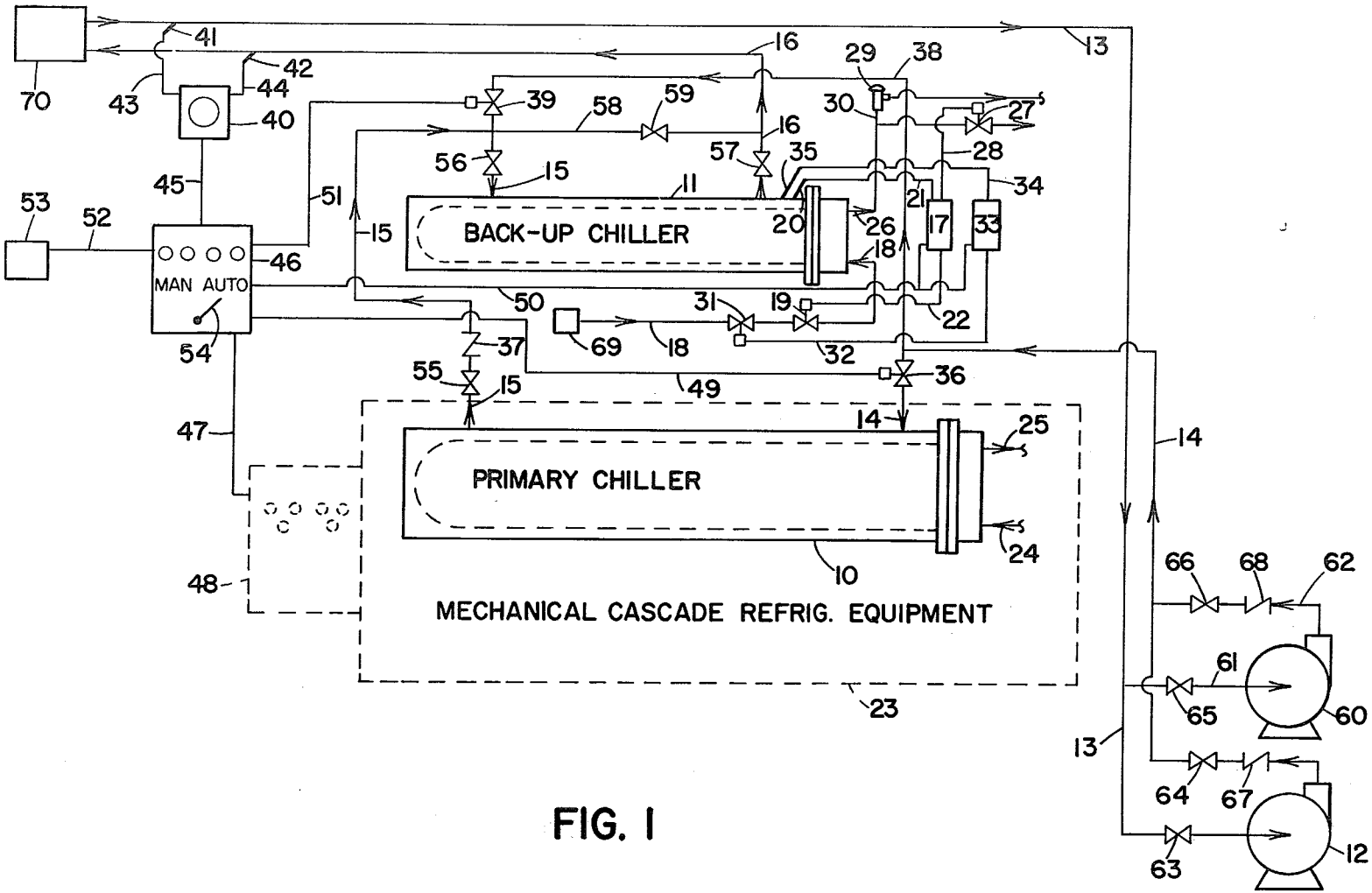

With reference to the accompanying drawing, the apparatus of the present invention is schematically shown as the combination of elements for subsequently cooling chamber 70. The inventive apparatus basically comprises the elements of primary first chiller 10; back-up second chiller 11; refrigerant pump 12; refrigerant conduits 13, 14, 15 and 16 for circulating refrigerant in series through pump 12, first chiller 10 and second chiller 11; first sensor 17 connected to a sensing element 20 through line 21; liquid nitrogen supply conduit 18 connected from liquid nitrogen supply 69 to second chiller 11; and control valve 19 in conduit 18 which is responsive to signals from sensor 17 through line 22. Refrigerant conduits 13 and 16 communicate with cooling coils (not shown) in cooling chamber 70 whereby the refrigerant appropriately cools chamber 70. The refrigerant employed in the above system is preferably liquid trichlorofluoromethane known generically as refrigerant R-11 having a freezing point of −168° F. (−111° C.,) but other well-known refrigerants can also be used.

First chiller 10 is a part of a primary mechanical cascade refrigeration system shown schematically in broken lines by block 23. First chiller 10 comprises a heat exchanger having inlet conduit 24 and outlet conduit 25 communicating with one side of the heat exchanger and having inlet conduit 14 and outlet conduit 15 communicating with the other side of the heat exchanger. Conduits 24 and 25 provide a passage for the primary refrigerant from the cascade refrigeration system components (not shown). Other than the chiller 10, the details of system 23 are well-known and form no part of the present invention.

Second chiller 11 comprises a heat exchanger having inlet conduit 15 and outlet conduit 16 communicating with one side of the heat exchanger and having inlet conduit 18 and outlet conduit 26 communicating with the other side of the heat exchanger. Inlet conduit 18 communicates with the source of liquid nitrogen 69 and has a normally-closed solenoid control valve 19 located therein. Outlet conduit 26 has a normally-closed solenoid valve 27 located therein. Circulation of the refrigerant from first chiller 10 through conduit 15 to second chiller 11 in series will maintain one side of chiller 11 at the desirably low temperature of the refrigerant.

Sensing element 20 is located in the circulating refrigerant side of second chiller 11. In the event that the temperature of the circulating refrigerant in second chiller 11 rises above a predetermined level, first sensor 17 will provide an output signal through line 22 to normally-closed solenoid control valve 19 which will open valve 19 and allow liquid nitrogen to enter one side of second chiller 11 and cool the circulating refrigerant on the other side of the second chiller 11. First sensor 17 is also connected through line 28 to valve 27 and will simultaneously send an output signal to open valve 27 to allow gaseous nitrogen to be released from second chiller 11 through outlet conduit 26. A pressure relief valve 29 is connected to conduit 26 through conduit 30 to relieve any excessive gas pressure that may develop in the nitrogen side of second chiller 11. As soon as the circulating refrigerant temperature drops below a predetermined level, as detected by sensing element 20, first sensor 17 will send output signals along lines 22 and 28 to close valves 19 and 27.

As a precaution to prevent an undesirably low temperature from being reached in second chiller 11 with attendant freezing and clogging of the chiller and conduits, inlet conduit 18 also preferably includes a normally-open solenoid valve 31. Valve 31 is connected by line 32 to a second sensor 33 which is in turn connected by line 34 to a sensing element 35 which is located in the circulating refrigerant side of the second chiller 11. In the event that the temperature of the circulating refrigerant in second chiller 11 drops below a predetermined level, this may be the result of a malfunction of sensing element 20, first sensor 17 and/or valve 19 which failed to close valve 19 and to stop flow of liquid nitrogen to second chiller 11. In this case sensing element 35 detects the undesirably low temperature, second sensor 33 sends output signals to valve 31 to close and thus stop flow of liquid nitrogen to second chiller 11.

In a further preferred form of the apparatus of the present invention, conduit 14 contains normally-open motor-driven valve 36, conduit 15 contains check-valve 37, and conduit 38, having a normally-closed motor-driven valve 39 located therein, is connected between conduits 14 and 15 as shown. A third sensor 40, which can conveniently be a temperature recorder controller, is connected to sensing elements 41 and 42 through lines 43 and 44 respectively. Sensing element 41 is located in conduit 13, whereas sensing element 42 is located in conduit 16. These sensing elements are thus used to sense the temperature of the circulating refrigerant at a location remote from first chiller 10 or second chiller 11 and thus sense a circulating refrigerant temperature which is more representative of the circulating refrigerant temperature in remotely located cooling chamber 70. Third sensor 40 is connected through line 45 to a liquid nitrogen control panel 46. Control panel 46 is in turn connected through line 47 to a control panel 48 associated with primary refrigeration system 23, through line 49 to valve 36, through line 50 to first sensor 17 and second sensor 33, through line 51 to valve 39, and through line 52 to an alarm 53. Panel 46 contains a switch 54 having alternative operative positions "AUTO" and "MAN". In the usual or "AUTO" position, first and second sensors 17 and 33 cannot provide output signals to control liquid nitrogen to second chiller 11 until third sensor 40 provides a suitable output signal. This is the desired back-up mode. In the manual or "MAN" position, the first sensor 17, the second sensor 33 and the third sensor 40 can operate independently. In this case the second chiller 11 can be used, for example, to increase the rate of cooling of the circulating refrigerant during start-up of the primary refrigeration system 23.

In the event that the temperature of the circulating refrigerant in line 13 or line 16 rises above a predetermined level, the appropriate sensing element 41 or 42 will send a signal to third sensor 40 which in turn will send an appropriate output signal to control panel 46. Panel 46 will activate alarm 53 at an appropriate local and/or remote station to enable the operating personnel to know that a refrigeration problem exists. Panel 46 will also send a signal to control panel 48 to shut-down the primary refrigeration system 23. Panel 46 will further send signals to close valve 36 and to open valve 39. This will enable the circulating refrigerant to by-pass first chiller 10 and thus pass directly from pump 12 through conduits 14, 38 and 15 to second chiller 11. Check valve 37 will prevent any circulating refrigerant from flowing back into first chiller 10. Appropriate signals will also be sent along line 50 to activate sensors 17 and 33 to enable sufficient liquid nitrogen to enter second chiller 11 and thus cool the circulating refrigerant in conduit 16 to the desired level. The above sequence of events will occur when switch 54 is in the "AUTO" position. If switch 54 is in the "MAN" position, appropriate signals are sent along line 50 to maintain sensors 17 and 33 continually in an active state.

Conduit 15 also preferably contains normally-open valves 55 and 56 as shown. Conduit 16 also contains normally-open valve 57 as shown. Conduit 58 containing normally-closed valve 59 is also preferably connected as shown between conduits 15 and 16. In the event that first chiller 10 needs to be disconnected for repairs of replacement, valves 36 and 55 are closed to prevent loss of circulating refrigerant. In the event that second chiller 11 needs to be disconnected for repairs or replacement, valves 56 and 57 are closed and valve 59 is opened so as to by-pass second chiller 11.

The apparatus also preferably contains a back-up refrigerant pump 60 connected to conduits 13 and 14 through conduits 61 and 62 respectively. Valves 63, 64, 65 and 66 are located as shown in conduits 13, 14, 61 and 62 respectively. Check valves 67 and 68 are located as shown in conduits 14 and 62. When pump 12 is operating, valves 63 and 64 are open and valves 65 and 66 are closed. If pump 12 ceases to work or if it is desired to operate pump 60, then valves 63 and 64 are closed and valves 65 and 66 are opened.

In a typical refrigeration situation wherein it is desired to maintain the temperature in the cooling chamber 70 at about −100° F. (−73° C.), the circulating refrigerant temperature in conduit 16 should be about −110° F. (−79° C.) and in conduit 13 should be about −105° F. (−76° C.). First sensor 17 can be set to open valve 19 when the circulating refrigerant temperature in second chiller 11 is above about −105° F. (−76° C.) and to close valve 19 when the circulating refrigerant temperature in second chiller 11 is below about −110° F. (−79° C.). Second sensor 33 can be set to close valve 31 when the circulating refrigerant temperature in second chiller 11 is below about −130° F. (−90° C.). Third sensor 40 can be set to activate alarm 53 and to shut down the mechanical refrigeration system 23 when the circulating refrigerant temperature in conduits 13 and 16 remote from chillers 10 and 11 is above about −90° F. (−68° C.).

The apparatus combination of the present invention has the advantages of rapid back-up response with minimal expense. Since the second chiller 11 is always in series with first chiller 10, it is continuously maintained at the circulating refrigerant temperature from the first chiller. If liquid nitrogen is to be introduced to second chiller 11, there will be minimal initial evaporation losses of the liquid nitrogen. There are also no completely separate refrigerant conduits and ancillary pumps for the second chiller, which would be the case if the first and second chillers were not in series.

What is claimed is:

1. Refrigeration apparatus for maintaining the temperature in a circulating refrigerant at or below a predetermined level which comprises in combination a first chiller associated with a primary refrigeration system, a second chiller, a refrigerant pump, refrigerant conduits for circulating refrigerant in series through said pump and said first and second chillers, a first sensor for sensing the temperature of the circulating refrigerant and providing output signals based thereon, valve means associated with said second chiller and responsive to signals from said first sensor for supplying liquid nitrogen from a source to said second chiller whenever the temperature of the circulating refrigerant rises above a predetermined level, a second sensor for sensing the temperature of the circulating refrigerant and providing output signals based thereon, and valve means associated with said second chiller and responsive to signals from said second sensor for stopping the supply of liquid nitrogen to said second chiller whenever the temperature of the circulating refrigerant drops below a predetermined level.

2. Apparatus according to claim 1 having a third sensor for sensing the temperature of the circulating refrigerant and providing output signals based thereon, and valve means in said refrigerant conduits responsive to signals from the third sensor for by-passing the first chiller whenever the temperature of the circulating refrigerant rises above a predetermined level.

3. Apparatus according to claim 1 wherein the second chiller has a liquid nitrogen supply inlet conduit with a normally-closed valve therein and has a gaseous nitrogen outlet conduit with a normally-closed valve therein, each of said valves being responsive to signals from the first sensor.

4. Apparatus according to claim 1 wherein the first sensor senses the temperature of the refrigerant circulating through the second chiller.

5. Apparatus according to claim 3 wherein the liquid nitrogen supply inlet conduit also has a normally-open valve therein, said valve being responsive to signals from a second sensor.

6. Apparatus according to claim 1 wherein the second sensor senses the temperature of the refrigerant circulating through the second chiller.

7. Apparatus according to claim 2 wherein the third sensor senses the temperature of the refrigerant circulating through the refrigerant conduits at a location remote from the first and second chillers.

8. Apparatus according to claim 2 wherein the first, second and third sensors are so interconnected that the third sensor must provide an output signal indicative of a circulating refrigerant temperature above a predetermined level in order to enable the first and second sensors to provide output signals for effecting liquid nitrogen supply to the second chiller.

9. Apparatus according to claim 2 wherein the first, second and third sensors are so connected that they and the respective valve means responsive to output signals therefrom operate independently.

* * * * *